US006738707B2

(12) United States Patent
Kotwicki et al.

(10) Patent No.: US 6,738,707 B2
(45) Date of Patent: May 18, 2004

(54) CYLINDER AIR CHARGE ESTIMATION SYSTEM AND METHOD FOR INTERNAL COMBUSTION ENGINE INCLUDING EXHAUST GAS RECIRCULATION

(75) Inventors: Allan J. Kotwicki, Williamsburg, MI (US); Steven Joseph Szwabowski, Northville, MI (US); Woong-chul Yang, Ann Arbor, MI (US); Yin Chen, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 237 days.

(21) Appl. No.: 10/003,365

(22) Filed: Nov. 15, 2001

(65) Prior Publication Data

US 2003/0093212 A1 May 15, 2003

(51) Int. Cl.[7] ..... F02D 41/18
(52) U.S. Cl. ..... 701/108; 73/117.3; 73/118.2
(58) Field of Search ..... 701/102, 108, 701/114; 73/117.3, 118.2

(56) References Cited

U.S. PATENT DOCUMENTS

| | | | | |
|---|---|---|---|---|
| 4,290,404 A | | 9/1981 | Hata et al. | 123/571 |
| 4,664,090 A | | 5/1987 | Kabasin | 123/494 |
| 5,205,260 A | | 4/1993 | Takahashi et al. | 123/494 |
| 5,520,161 A | | 5/1996 | Klopp | 123/676 |
| 5,974,870 A | | 11/1999 | Treinies et al. | 73/118.2 |
| 6,041,765 A | | 3/2000 | O'Neil et al. | 123/683 |
| 6,286,366 B1 | * | 9/2001 | Chen et al. | 73/117.3 |
| 6,321,732 B1 | * | 11/2001 | Kotwicki et al. | 73/117.3 |
| 6,609,058 B1 | * | 8/2003 | Russell et al. | 701/108 |

FOREIGN PATENT DOCUMENTS

| | | |
|---|---|---|
| DE | 196 36 451 | 3/1998 |
| DE | 197 40 917 | 10/1998 |
| DE | 197 39 901 | 3/1999 |
| GB | 2 359 857 | 9/2001 |

* cited by examiner

*Primary Examiner*—Andrew M. Dolinar

(57) ABSTRACT

A system (12) and method for determining the charged air mass in a cylinder (14) of an internal combustion engine (10) are provided. The system (12) includes an electronic control unit (ECU) (58) configured to determine a temperature of the combination of charged air and recirculated exhaust gas inducted into the cylinder (14). The ECU (58) is further configured to determine a total mass flow rate of the combination of inducted air and recirculated exhaust gas based on a pressure in an intake manifold (22) of the engine (10) and the previously determined temperature. Finally, the ECU (58) is configured to determine the mass of charged air in the cylinder (14) from the total mass flow rate.

30 Claims, 3 Drawing Sheets

—— = NO EGR
· · · = INCREASING EGR AT A FIRST VACUUM PRESSURE
□ □ □ = INCREASING EGR AT A SECOND VACUUM PRESSURE

CYLINDER AIR CHARGE ESTIMATION SYSTEM AND METHOD FOR INTERNAL COMBUSTION ENGINE INCLUDING EXHAUST GAS RECIRCULATION

FIELD OF THE INVENTION

This invention relates to systems and methods for control of fuel delivery to vehicle engines and, in particular, to a system and method for determining the mass of charged air in a cylinder of the engine.

BACKGROUND OF THE INVENTION

A conventional vehicle having a fuel-injected internal combustion engine includes a system for controlling the amount of fuel injected into each cylinder of the engine during a combustion event. The amount of fuel is controlled to achieve an optimal air-fuel ratio in the cylinders and thereby reduce emissions of hydrocarbons (HC), carbon monoxide (CO) and nitrous oxides ($NO_x$). In order to the determine the proper amount of fuel to be injected into the cylinder, the system determines or estimates the mass of charged air introduced to the cylinder. One conventional system for determining the mass of charged air is known as the "speed-density" system. The speed-density system relies on measurements or estimates of engine speed, intake manifold pressure, and charge temperature. Conventional vehicles, however, also frequently include a system for recirculating exhaust gas into the engine cylinders (also for the purpose of reducing emissions and improving fuel efficiencies). The variable amount of exhaust gas effects the intake of the charged air mass and the pressure in the intake manifold. Accordingly, the speed-density system often provides inaccurate measurements of the charged air mass in vehicles with an exhaust gas recirculation system.

U.S. Pat. No. 5,205,260 discloses a system for determining the charged air mass in an engine cylinder and attempts to account for recirculated exhaust gas through the estimation of partial pressures for the recirculated exhaust gas and the charged air in the intake manifold. The system, however, requires complex calculations and therefore requires a relatively large amount of resources from the vehicle's electronic control unit. Further, the system is still subject to significant errors in determining the charged air mass in the presence of recirculated exhaust gas.

There is thus a need for a system and method for determining the mass of charged air in a cylinder of an internal combustion engine that will minimize and/or eliminate one or more of the above-identified deficiencies.

SUMMARY OF THE INVENTION

The present invention provides a system and a method for determining the mass of charged air in a cylinder of an internal combustion engine having an intake manifold communicating with an engine cylinder. A method in accordance with the present invention includes the step of determining a temperature of a combination of charged air and recirculated exhaust gas inducted into the engine cylinder. The method also includes the step of determining a total mass flow rate responsive to a pressure in the intake manifold and the temperature of the combination of charged air and recirculated exhaust gas. The total mass flow rate includes a mass flow rate of the charged air and a mass flow rate of the recirculated exhaust gas. The total mass flow rate may also include other components such as purge flow from a charcoal canister. The method further includes the step of calculating the mass of charged air from the total mass flow rate.

A system in accordance with the present invention includes an electronic control unit that is configured, or encoded, to perform several functions. In particular, the unit is configured to determine a temperature of a combination of charged air and recirculated exhaust gas inducted into the engine cylinder. The system is also configured to determine a total mass flow rate responsive to a pressure in the intake manifold and the temperature of the combination of charged air and recirculated exhaust gas. The total mass flow rate again includes a mass flow rate of the charged air and a mass flow rate of the recirculated exhaust gas. The system is further configured to calculate the mass of charged air from the total mass flow rate.

The present invention represents an improvement as compared to conventional systems and methods for determining the mass of charged air in engine cylinders. In particular, the inventive system and method accurately account for recirculated exhaust gas in the engine cylinders in determining the charged air mass. Further, the inventive system and method accomplish this task using an algorithm and calculations that are less complex than conventional systems and methods. As a result, the inventive system and method do not require as many resources from the vehicle's electronic control unit.

These and other advantages of this invention will become apparent to one skilled in the art from the following detailed description and the accompanying drawings illustrating features of this invention by way of example.

DETAILED DESCRIPTION OF THE PREFERRED EMBODIMENT

Figure 1:
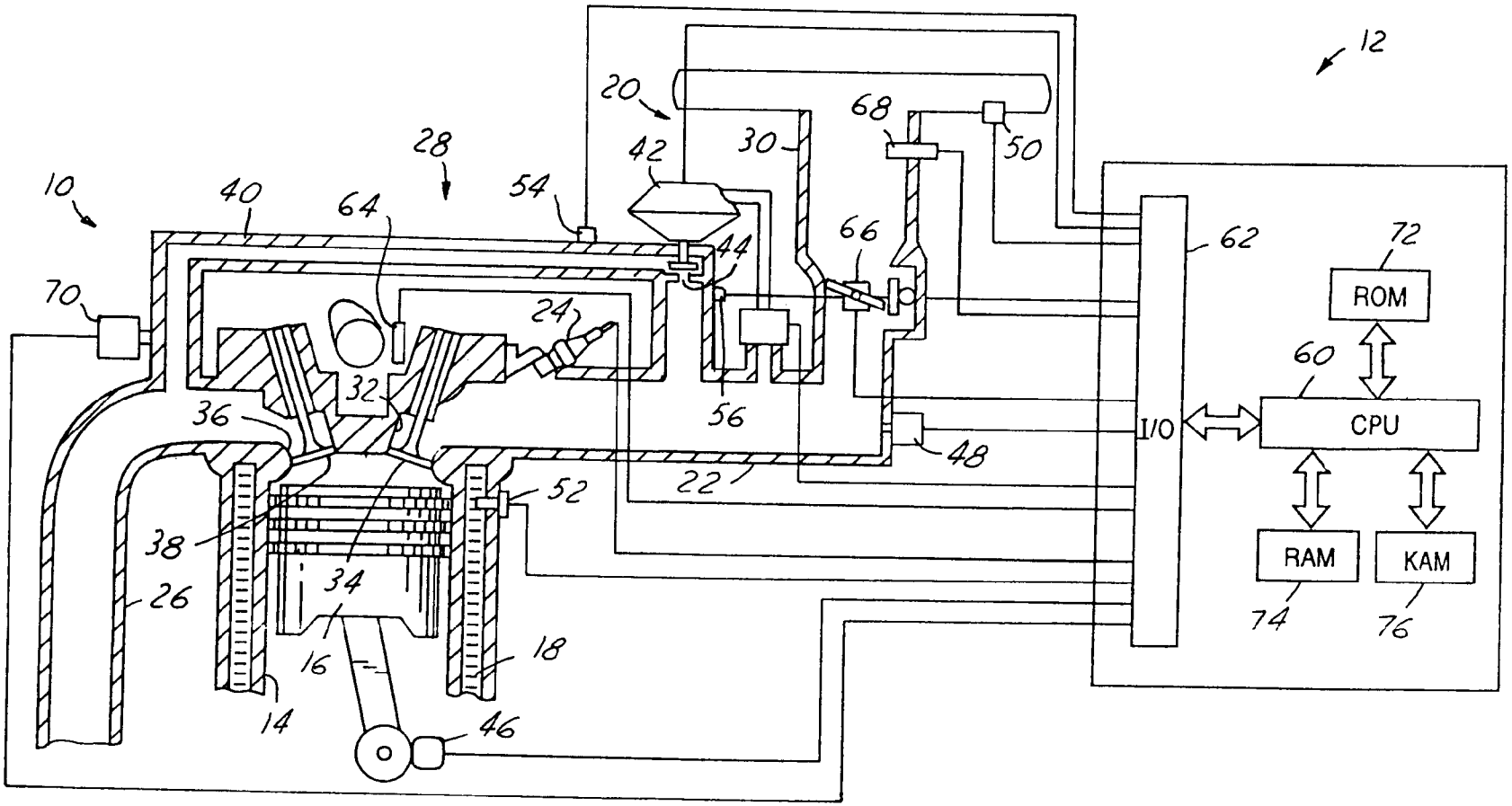
FIG. 1 is a schematic diagram illustrating an internal combustion engine incorporating a system for determining the mass of the charged air in a cylinder of an internal combustion engine in accordance with the present invention.

Referring now to the drawings wherein like reference numerals are used to identify identical components in the various views, FIG. 1 illustrates an internal combustion engine 10 and a system 12 in accordance with the present invention for determining the mass of charged air in a cylinder 14 of engine 10 during a combustion event. The mass of the charged air in cylinder 14 is used to determine the proper amount of fuel to inject into cylinder 14 in order to maintain a desired air/fuel ratio and control emissions of hydrocarbons, carbon monoxide and nitrous oxides.

Engine 10 is designed for use in a motor vehicle. It should be understood, however, that engine 10 may be used in a wide variety of applications. Engine 10 provides motive energy to a motor vehicle or other device and is conventional in the art. Engine 10 may define a plurality of combustion chambers or cylinders 14 and may also include a plurality of pistons 16, coolant passages 18, a throttle 20, an intake manifold 22, fuel injectors 24, an exhaust manifold 26, and an engine gas recirculation (EGR) system 28.

Cylinders 14 provide a space for combustion of an air/fuel mixture to occur and are conventional in the art. In the illustrated embodiment, only one cylinder 14 is shown. It will be understood, however, that engine 10 may define a plurality of cylinders 14 and that the number of cylinders 14 may be varied without departing from the spirit of the present invention. A spark plug (not shown) may be disposed within each cylinder 14 to ignite the air/fuel mixture in the cylinder 14.

Pistons 16 are coupled to a crankshaft (not shown) and drive the crankshaft responsive to an expansion force of the air-fuel mixture in cylinders 14 during combustion. Pistons 16 are conventional in the art and a piston 16 may be disposed in each cylinder 14.

Coolant passages 18 provide a means for routing a heat transfer medium, such as a conventional engine coolant, through engine 10 to transfer heat from cylinders 14 to a location external to engine 10. Passages 18 are conventional in the art.

Throttle 20 controls the amount of air delivered to intake manifold 22 and cylinders 14. Throttle 20 is conventional in the art and includes a throttle plate or valve (not shown) disposed within a throttle body 30. The position of the throttle plate may be responsive to the vehicle operator's actuation of an accelerator pedal.

Intake manifold 22 provides a means for delivering charged air to cylinders 14. Manifold 22 is conventional in the art. An inlet port 32 is disposed between manifold 22 and each cylinder 14. An intake valve 34 opens and closes each port 32 to control the delivery of air and fuel to the respective cylinder 14.

Fuel injectors 24 are provided to deliver fuel in controlled amounts to cylinders 14 and are conventional in the art. Although only one fuel injector 24 is shown in the illustrated embodiment, it will again be understood that engine 10 will include additional fuel injectors for delivering fuel to other cylinders 14 in engine 10.

Exhaust manifold 26 is provided to vent exhaust gases from cylinders 14 after each combustion event. Manifold 26 is also conventional in the art and may deliver exhaust gases to a catalytic converter (not shown). An exhaust port 36 is disposed between manifold 26 and each cylinder 14. An exhaust valve 38 opens and closes each port 36 to control the venting of exhaust gases from the respective cylinder 14.

EGR system 28 is provided to return a portion of the exhaust gases to cylinders 14 in order to reduce emissions of combustion by-products. EGR system 28 includes a passage 40 that extends from exhaust manifold 26 to intake manifold 22 and an EGR valve 42 that may be disposed within passage 40 to control the delivery of recirculated exhaust gases to intake manifold 22. EGR passage 40 may define an orifice 44 for a purpose described hereinbelow.

System 12 is provided to determine the mass of charged air provided to each cylinder 14 during each combustion event. System 12 may form part of a larger system for controlling fuel injectors 24 and the delivery of fuel to each cylinder 14 during each combustion event. System 12 may include a profile ignition pickup (PIP) sensor 46, a manifold absolute pressure (MAP) sensor 48, an air temperature sensor 50, an engine coolant temperature sensor 52, and pressure sensors 54, 56. System also includes an electronic control unit (ECU) 58.

PIP sensor 46 is provided to indicate the position of the engine crankshaft (not shown) and is conventional in the art. Sensor 46 generates a signal that is indicative of the speed of engine 10 and is input to ECU 58.

MAP sensor 48 is used to measure the air pressure within intake manifold 22 and is also conventional in the art. Sensor 48 generates a signal that is indicative of the pressure in manifold 22 and is input to ECU 58.

Air temperature sensor 50 is used to measure the temperature of charged air delivered to intake manifold 22 through throttle 20. Sensor 50 is conventional in the art and may be disposed proximate the inlet of throttle body 30. Sensor 50 generates a signal that is indicative of the air temperature and is input to ECU 58.

Engine coolant temperature sensor 52 is used to measure the temperature of engine coolant in one of coolant passages 18 and is also conventional in the art. Sensor 52 may be disposed in one of the walls of a coolant passage 18 and also generates a signal that is input to ECU 58. The signal is indicative of the temperature of engine.

Pressure sensors 54, 56 are provided to measure the air pressure of the recirculated exhaust gas on either side of orifice 44 in EGR passage 40. Sensors 54, 56 are conventional in the art. Sensors 54, 56 generate signals that are input to ECU 58 and which may be used by ECU 58 to determine the mass flow rate of the recirculated exhaust gas. The signal generated by MAP sensor 48 may alternatively be used in place of the signal generated by sensor 56.

ECU 58 is provided to control engine 10. Unit 58 may comprise a programmable microprocessor or microcontroller or may comprise an application specific integrated circuit (ASIC). ECU 58 may include a central processing unit (CPU) 60 and an input/output (I/O) interface 62. Through interface 62, ECU 58 may receive a plurality of input signals including signals generated by sensors 46, 48, 50, 52, 54, 56 and other sensors, such as a cylinder identification (CID) sensor 64, a throttle position sensor 66, a mass air flow (MAF) sensor 68, and a Heated Exhaust Gas Oxygen (HEGO) sensor 70. Also through interface 62, ECU 58 may generate a plurality of output signals including one or more signals used to control fuel injectors 24 and one or more signals used to control the spark plugs (not shown) in each cylinder 14. ECU 58 may also include one or more memories including, for example, Read Only Memory (ROM) 72, Random Access Memory (RAM) 74, and a Keep Alive Memory (KAM) 76 to retain information when the ignition key is turned off.

Referring now to FIGS. 2A–2E, a method for determining the mass of charged air in a cylinder 14 of engine 10 will be described. The method or algorithm may be implemented by system 12 wherein ECU 58 is configured to perform several steps of the method by programming instruction or code (i.e., software). The instructions may be encoded on a computer storage medium such as a conventional diskette or CD-ROM and may be copied into memory 72 of ECU 58 using conventional computing devices and methods.

Figure 2A:
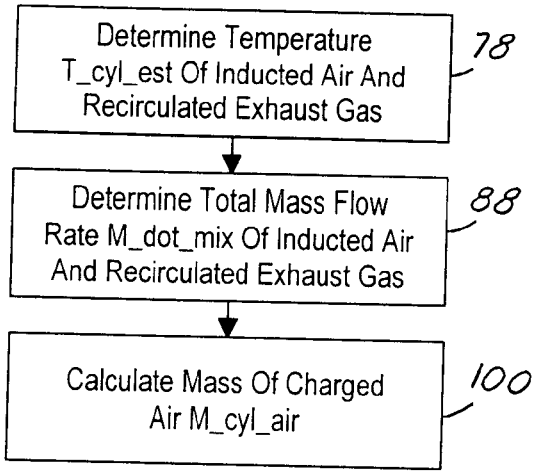
FIGS. 2A–2E are flow chart diagrams illustrating a method for determining the mass of the charged air in a cylinder of an internal combustion engine in accordance with the present invention.

Referring to FIG. 2A, a method in accordance with the present invention may include several steps. The inventive method may begin with the step 78 of determining a temperature of the combination of charged air and recirculated exhaust gas inducted into cylinder 14.

Figure 2C:
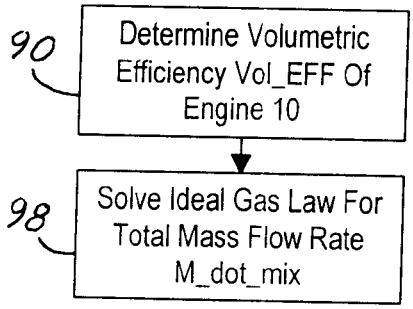
Figure 2B:
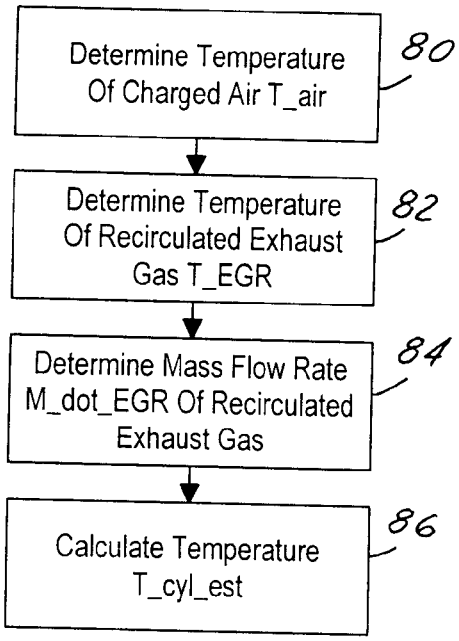

Referring now to FIG. 2B, step 78 may include several substeps including the substep 80 of determining a temperature of the charged air inducted into cylinder 14. Referring to FIG. 1, the determination of the charged air temperature T_air may be made using air temperature sensor 50. Sensor 50 generates a signal indicative of the temperature T_air of the charged air and provides this signal to ECU 58. Sensor 50 should be located upstream of the entry point of any recirculated exhaust gas.

Referring again to FIG. 2B, step 78 may also include the substep 82 of determining a temperature T_EGR of the recirculated exhaust gas inducted into cylinder 14. The actual temperature of the recirculated exhaust gas may be determined in a variety of ways known in the art. See, e.g., commonly assigned U.S. Pat. No. 5,414,994, the entire disclosure of which is incorporated herein by reference. However, experimental evidence indicates that the recirculated exhaust gas temperature operates within a relatively constant range (e.g., 1000F-1250F) irrespective of engine operating conditions. As set forth hereinbelow, the recirculated exhaust gas temperature T_EGR is used along with the mass flow rate M_dot_EGR of the recirculated exhaust gas to obtain the rate of heat energy Q_dot_EGR provided by the recirculated exhaust gas. Because the mass flow rate M_dot_EGR of recirculated exhaust gas varies responsive to the inverse square root of the temperature T_EGR and the temperature T_EGR falls within a relatively constant range, a predetermined value can be assigned to the temperature T_EGR (e.g., the geometric mean of the anticipated temperature range) without significantly affecting Q_dot_EGR.

Step 78 may further include the substep 84 of determining the mass flow rate of the recirculated exhaust gas. The mass flow rate M_dot_EGR of recirculated exhaust gas can be determined in several ways as is known in the art. In one embodiment of the invention the mass flow rate M_dot_EGR is determined by measuring a pressure drop across orifice 44 in EGR passage 40. Accordingly, substep 84 may include the substeps of measuring a first pressure on a first side of orifice 44 and a second pressure on a second side of orifice 44. These measurements may be obtained by conventional pressure sensors 54, 56 disposed on either side of orifice 44. Alternatively, one of the pressure measurements may be made by MAP sensor 48. Substep 84 may further include the substep of calculating the recirculated exhaust gas mass flow rate M_dot_EGR responsive to the first and second pressures in a conventional manner. In particular, ECU 58 may be configured, or encoded, to perform this calculation responsive to signals generated by pressure sensors 54, 56 (or 48).

Step 78 may finally include the substep 86 of calculating the temperature T_cyl_est of the combination of the charged air and recirculated exhaust gas inducted into cylinder 14 responsive to the charged air temperature T_air, the recirculated exhaust gas temperature T_EGR, the recirculated exhaust gas mass flow rate M_dot_EGR and a previously estimated charged air mass flow rate M_dot_air (the previously estimated charged air mass flow rate M_dot_air may be calculated as set forth hereinbelow). In particular, the estimated temperature T_cyl_est in cylinder 14 may be calculated as follows:

$$\text{T_cyl_est} = \frac{\text{Q_dot_air} + \text{Q_dot_EGR} + \text{Q_dot_engine}}{(\text{M_dot_air} + \text{M_dot_EGR}) * C_P}$$

where Q_dot_air and Q_dot_EGR correspond to the rate of transfer of heat energy from the air and the recirculated exhaust gas, respectively, to cylinder 14, Q_dot_engine corresponds to the rate of transfer of heat energy from intake manifold 22 to the charged air and recirculated exhaust gas as the air and exhaust gas travel from manifold 22 to cylinder 14, and $C_P$ represents an average value of the specific heat of the mixture of air and recirculated exhaust gas. Because $$\frac{\text{Q_dot_air}}{C_P} = (\text{M_dot_air} * \text{T_air}) \text{ and}$$

$$\frac{\text{Q_dot_EGR}}{C_P} = (\text{M_dot_EGR} * \text{T_EGR})$$

T_cyl_est may be rewritten as:

$$\text{T_cyl_est} = \frac{(\text{M_dot_air} * \text{T_air}) + (\text{M_dot_EGR} * \text{T_EGR}) + \frac{\text{Q_dot_engine}}{C_P}}{(\text{M_dot_air} + \text{M_dot_EGR})}$$

ECU 58 may therefore calculate the estimated temperature for cylinder 14 responsive to the mass flow rates M_dot_air and M_dot_EGR and temperatures T_air and T_EGR of the air and recirculated exhaust gas inducted into cylinder 14. Assuming that there is no recirculated exhaust gas, the above equation may be solved as follows for Q_dot_engine:

$$Q_\text{dot_engine} = M_\text{dot_air} * (T_cyl_est - T_\text{air}) * C_P$$

Figure 3:
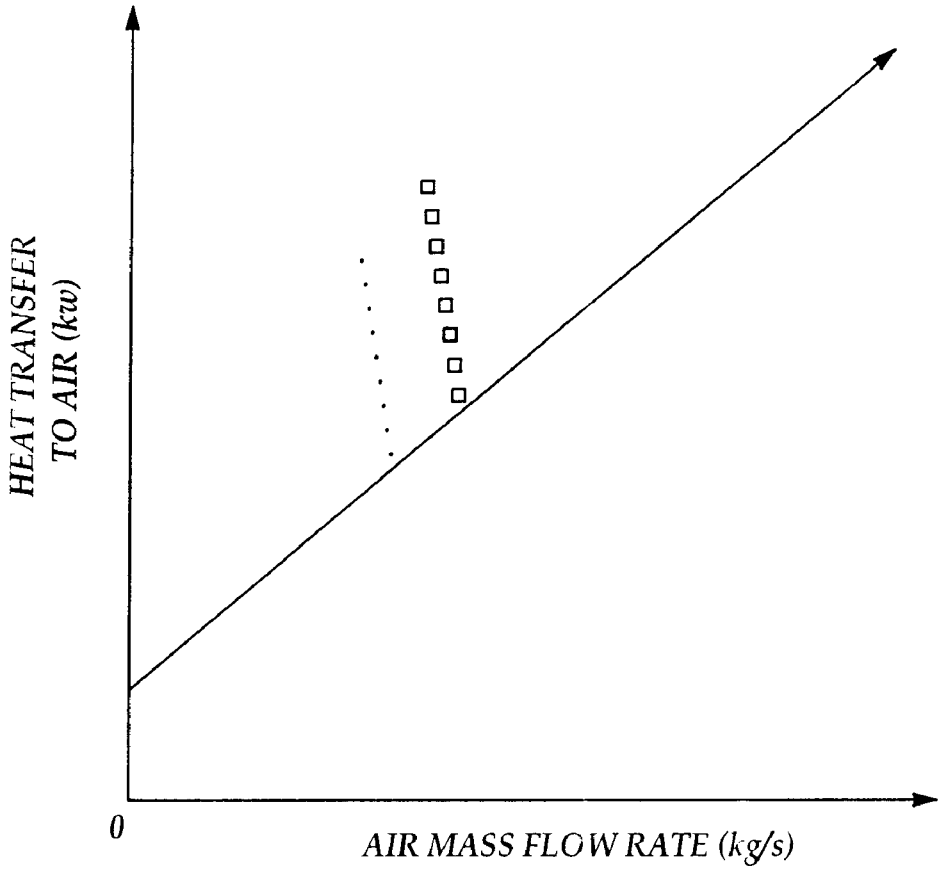
FIG. 3 is a graphical illustration of heat transfer in an internal combustion engine relative to air mass flow rate in the engine.

Referring to FIG. 3, experimental evidence using temperature measurements at throttle 30 and intake port 32 has shown that Q_dot_engine varies generally linearly relative to the air mass flow rate M_dot_mix when there is no recirculated exhaust gas. From this evidence, the following equation may be obtained for Q_dot_engine:

$$Q_\text{dot_engine} = A * (M_\text{dot_air} + M_\text{dot_}EGR) + B$$

where A and B are constants determined as a function of engine coolant temperature and air charge temperature as measured by sensors 52, 50, respectively and vehicle speed and underhood ambient temperature.

Referring again to FIG. 2A, a method in accordance with the present invention may also include the step 88 of determining a total mass flow rate M_dot_mix responsive to a pressure in intake manifold 22 and the temperature T_cyl_est. The total mass flow rate M_dot_mix includes a mass flow rate M_dot_air of the charged air inducted into cylinder 14 and a mass flow rate M_dot_EGR of the recirculated exhaust gas inducted into cylinder 14.

Referring now to FIG. 2C, step 88 may include the substep 90 of determining a volumetric efficiency Vol_Eff of engine 10. Volumetric efficiency may be determined in several conventional ways including the use of engine mapping data or by performing calculations based on measurements of the speed of engine 10 and the absolute pressure in intake manifold 22. Alternatively, a representation of volumetric efficiency may be obtained using a slope and offset method responsive to the estimated cylinder temperature T_cyl_est.

Figure 2D:
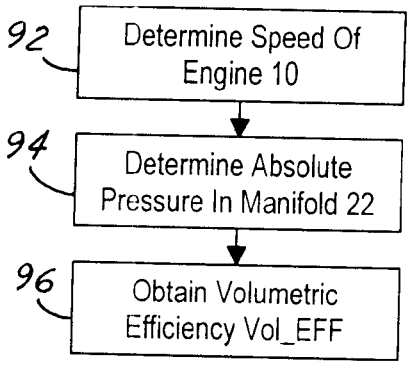

Referring to FIG. 2D, in one embodiment of the invention substep 90 itself includes the substeps 92, 94 of determining the speed of engine 10 and the absolute pressure in intake manifold 22. ECU 58 may be configured, or encoded, to determine the speed of engine 10 and the absolute pressure in manifold 22 responsive to signals generated by PIP sensor 46 and MAP sensor 48, respectively. Substep 90 may further include the substep 96 of obtaining the volumetric efficiency Vol_Eff responsive to the engine speed and the intake manifold absolute pressure. Substep 96 may itself include a substep of accessing a memory, such as memory 72, responsive to the measured engine speed and measured intake manifold absolute pressure. In particular, memory 72 may include data comprising volumetric efficiency values that are arranged in a two-dimensional data structure stored in memory 72. ECU 58 may be configured, or encoded, to access the data structure using engine speed and intake manifold absolute pressure. Substep 96 may also include the substep of interpolating between a plurality of values retrieved from memory 72 responsive to the engine speed and intake manifold absolute pressure. In particular, because the data structure may only contain volumetric efficiency values for discrete values of engine speed and intake manifold absolute pressure, ECU 58 may be configured, or encoded, to interpolate between a plurality of values retrieved from memory 72. For example, in response to a measured engine speed and a measured manifold pressure, four volumetric efficiency values may be retrieved using discrete engine speed and manifold pressures that are higher and lower than the measured values. ECU 58 may then interpolate between these retrieved values to obtain the volumetric efficiency Vol_Eff of engine 10.

Referring again to FIG. 2C, step 88 may further include the substep 98 of solving the ideal gas law for the total mass flow rate M_dot_mix using the volumetric efficiency Vol_Eff of engine 10, the pressure in intake manifold 22, a speed of engine 10, and estimated temperature T_cyl_est of the combination of charged air and recirculated exhaust gas inducted into cylinder 14. In particular, ECU 58 may be configured, or encoded, to solve the ideal gas law for the total air mass flow rate M_dot_mix as follows:

$$\text{M_dot_mix} = \frac{\text{Vol_Eff} * MAP * \frac{\text{Eng_Disp}}{2} * RPM}{\text{R_ideal} * \text{T_cyl_est}}$$

where Vol_Eff represents the previously obtained volumetric efficiency, MAP represents the intake manifold absolute pressure, Eng_Disp represents swept displacement of engine 10, RPM represents the speed of engine 10, R_ideal is predetermined constant, and T_cyl_est represents the previously obtained cylinder temperature. It should be understood by those of skill in the art that this equation and other equations contained herein are adapted for use with a four cycle engine and that modifications may be readily made to the equations for a two cycle engine.

Figure 2E:
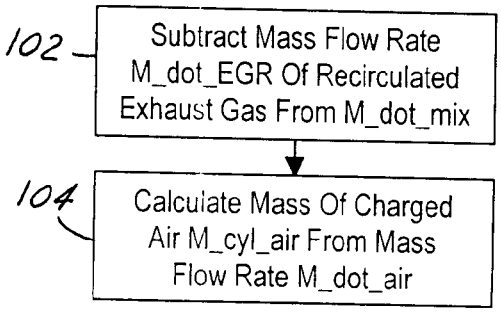

Referring again to FIG. 2A, the inventive method may finally include the step 100 of determining the charged air mass M_air_cyl from the total air mass flow rate M_dot_mix. Referring to FIG. 2E, step 100 may include several substeps including the substep 102 of subtracting the mass flow rate M_dot_EGR of recirculated engine gas from the total air mass flow rate M_dot_mix to obtain the mass flow rate M_dot_air of the charged air. ECU 58 may again be configured, or encoded to perform this calculation and the value for M_dot_air may be stored in one or more of memories 72, 74, 76 for use in determining the cylinder temperature during the next combustion event as described hereinabove.

Finally, step 100 includes the substep 104 of calculating the mass M_air_cyl of charged air in cylinder 14 responsive to the charged air mass flow rate M_dot_air. The mass M_air_cyl of charged air in cylinder 14 may be determined as follows:

$$\text{M_air_cyl} = \frac{2 * \text{M_dot_air}}{RPM * \text{num_cyl}}$$

where M_dot_air represents the mass flow rate of the charged air, RPM represents the speed of engine 10, and num_cyl represents the number of cylinders 14 in engine 10. ECU 58 may again be configured, or encoded, to perform this calculation.

A system and method in accordance with the present invention for determining the charged air mass in a cylinder of an internal combustion engine represent a significant improvement as compared to conventional systems and methods. The inventive system and method are more accurate than conventional systems and methods because the inventive system and method more accurately account for recirculated exhaust gas in the engine cylinders in determining the charged air mass. As a result, method and system enable more precise control of the amount of fuel injected into the cylinders and the air/fuel ratio. The inventive system and method also accomplish this task using an algorithm and calculations that are less complex than conventional systems and methods. As a result, the inventive system and method does not require as many resources from the vehicle's electronic control unit.

We claim:

1. A method for determining a mass of charged air in a cylinder of an internal combustion engine, said engine having an intake manifold communicating with an engine cylinder, said method comprising the steps of:

determining a temperature of a combination of charged air and recirculated exhaust gas inducted into said cylinder of said engine;

determining a total mass flow rate responsive to a pressure in said intake manifold and said temperature, said total mass flow rate including a mass flow rate of said charged air and a mass flow rate of said recirculated exhaust gas; and, calculating said mass of charged air from said total mass flow rate.

2. The method of claim 1 wherein said step of determining a temperature includes the substeps of:

determining a temperature of said charged air;

determining a temperature of said recirculated exhaust gas;

determining said mass flow rate of said recirculated exhaust gas; and, calculating said temperature of said combination responsive to said charged air temperature, said recirculated exhaust gas temperature, said recirculated exhaust gas mass flow rate and a previously estimated charged air mass flow rate.

3. The method of claim 2 wherein said substep of determining said mass flow rate of recirculated exhaust gas includes the substeps of:

measuring a first pressure on a first side of an orifice disposed in a flow path of said recirculated exhaust gas;

measuring a second pressure on a second side of said orifice; and, calculating said mass flow rate of recirculated exhaust gas responsive to said first and second pressures.

4. The method of claim 3 wherein said second pressure comprises an absolute pressure in said intake manifold.

5. The method of claim 1 wherein said step of determining a total mass flow rate includes the substeps of:

determining a volumetric efficiency of said engine; and, solving the ideal gas law for said total mass flow rate using said volumetric efficiency, said pressure in said intake manifold, a speed of said engine, and said temperature of said combination of charged air and recirculated exhaust gas.

6. The method of claim 5 wherein said substep of determining a volumetric efficiency includes the substeps of:

determining a speed of said engine and an absolute pressure in said intake manifold; and, obtaining said volumetric efficiency responsive to said speed and said absolute pressure.

7. The method of claim 6 wherein said step of obtaining said volumetric efficiency includes the substep of accessing a memory responsive to said speed and said absolute pressure.

8. The method of claim 7 wherein said step of obtaining said volumetric efficiency further includes the substep of interpolating between a plurality of values retrieved from said memory responsive to said speed and said absolute pressure.

9. The method of claim 1 wherein said step of calculating said mass of charged air from said total mass flow rate includes the substeps of:

subtracting said mass flow rate of recirculated exhaust gas from said total mass flow rate to obtain said mass flow rate of said charged air; and, calculating said mass of charged air responsive to said mass flow rate of said charged air.

10. A system for determining a mass of charged air in a cylinder of an internal combustion engine, said engine having an intake manifold communicating with an engine cylinder, said system comprising:

an electronic control unit configured to determine a temperature of a combination of charged air and recirculated exhaust gas inducted into said cylinder of said engine, to determine a total mass flow rate responsive to a pressure in said intake manifold and said temperature, said total mass flow rate including a mass flow rate of said charged air and a mass flow rate of said recirculated exhaust gas, and to calculate said mass of charged air from said total mass flow rate.

11. The system of claim 10 wherein said electronic control unit is further configured, in determining said temperature of said combination, to determine said mass flow rate of said recirculated exhaust gas, and to calculate said temperature of said combination responsive to a temperature of said charged air, a temperature of said recirculated exhaust gas, said recirculated exhaust gas mass flow rate and a previously estimated charged air mass flow rate.

12. The system of claim 11, further comprising:

a first pressure sensor disposed on a first side of an orifice disposed in a flow path of said recirculated engine gas; and, a second pressure sensor disposed on a second side of said orifice wherein said electronic control unit is further configured, in determining said mass flow rate of recirculated engine gas, to calculate said mass flow rate of recirculated engine gas responsive to said first and second pressures.

13. The system of claim 12 wherein said second pressure comprises an absolute pressure in said intake manifold.

14. The system of claim 10 wherein said electronic control unit is further configured, in determining said total mass flow rate, to determine a volumetric efficiency of said engine, and to solve the ideal gas law for said total mass flow rate using said volumetric efficiency, said pressure in said intake manifold, a speed of said engine, and said temperature of said combination of charged air and recirculated exhaust gas.

15. The system of claim 14 wherein said system includes:

means for determining a speed of said engine; and, a sensor for measuring an absolute pressure in said intake manifold wherein said electronic control unit is further configured, in determining said volumetric efficiency of said engine, to obtain said volumetric efficiency responsive to said speed and said absolute pressure.

16. The system of claim 15, further comprising a memory and wherein said electronic control unit is further configured, in obtaining said volumetric efficiency of said engine, to access said memory responsive to said speed and said absolute pressure.

17. The system of claim 16 wherein said electronic control unit is further configured, in obtaining said volumetric efficiency of said engine, to interpolate between a plurality of values retrieved from said memory responsive to said speed and said absolute pressure.

18. The system of claim 10 wherein said electronic control unit is further configured, in determining said mass of charged air from said total mass flow rate, to subtract said mass flow rate of recirculated engine gas from said total mass flow rate to obtain said mass flow rate of said charged air and to calculate said mass of charged air responsive to said mass flow rate of said charged air.

19. An article of manufacture, comprising:

a computer storage medium having a computer program encoded therein for determining a mass of charged air in a cylinder of an internal combustion engine, said engine having an intake manifold communicating with an engine cylinder, said computer program including:

code for determining a temperature of a combination of charged air and recirculated exhaust gas inducted into said cylinder of said engine;

code for determining a total mass flow rate responsive to a pressure in said intake manifold and said temperature, said total mass flow rate including a mass flow rate of said charged air and a mass flow rate of said recirculated exhaust gas; and, code for calculating said mass of charged air from said total mass flow rate.

20. The article of manufacture of claim 19 wherein said code for determining a temperature includes:

code for determining said mass flow rate of said recirculated exhaust gas; and, code for calculating said temperature of said combination responsive to a temperature of said charged air, a temperature of said recirculated exhaust gas, said recirculated exhaust gas mass flow rate and a previously estimated charged air mass flow rate.

21. The article of manufacture of claim 20 wherein said code for determining said mass flow rate of recirculated exhaust gas includes code for calculating said mass flow rate of recirculated exhaust gas responsive to a first pressure on a first side of an orifice disposed in a flow path of said recirculated exhaust gas and a second pressure on a second side of said orifice.

22. The article of manufacture of claim 21 wherein said second pressure comprises an absolute pressure in said intake manifold.

23. The article of manufacture of claim 19 wherein said code for determining a total mass flow rate includes:

code for determining a volumetric efficiency of said engine; and, code for solving the ideal gas law for said total mass flow rate using said volumetric efficiency, said pressure in said intake manifold, a speed of said engine, and said temperature of said combination of charged air and recirculated exhaust gas.

24. The article of manufacture of claim 23 wherein said code for determining a volumetric efficiency includes code for obtaining said volumetric efficiency responsive to a speed of said engine and an absolute pressure in said intake manifold.

25. The article of manufacture of claim 24 wherein said code for obtaining said volumetric efficiency includes code for accessing a memory responsive to said speed and said absolute pressure.

26. The article of manufacture of claim 25 wherein said code for obtaining said volumetric efficiency further includes code for interpolating between a plurality of values retrieved from said memory responsive to said speed and said absolute pressure.

27. The article of manufacture of claim 19 wherein said code for calculating said mass of charged air from said total mass flow rate further includes:

code for subtracting said mass flow rate of recirculated exhaust gas from said total mass flow rate to obtain said mass flow rate of said charged air; and, code for calculating said mass of charged air responsive to said mass flow rate of said charged air.

28. A method for estimating a temperature in a cylinder of an internal combustion engine, comprising the steps of:

determining a mass flow rate for charged air inducted into said cylinder;

determining a mass flow rate for recirculated exhaust gas inducted into said cylinder;

determining a temperature of said charged air;

determining a temperature of said recirculated exhaust gas; and, calculating said temperature in said cylinder responsive to said mass flow rates of said charged air and said recirculated exhaust gas and said temperatures of said charged air and said recirculated exhaust gas.

29. A system for estimating a temperature in a cylinder of an internal combustion engine, comprising:

an electronic control unit configured to:

determine a mass flow rate for charged air inducted into said cylinder;

determine a mass flow rate for recirculated exhaust gas inducted into said cylinder;

determine a temperature of said charged air;

determine a temperature of said recirculated exhaust gas; and, calculate said temperature in said cylinder responsive to said mass flow rates of said charged air and said recirculated exhaust gas and said temperatures of said charged air and said recirculated exhaust gas.

30. An article of manufacture comprising:

a computer storage medium having a computer program encoded therein for estimating a temperature in a cylinder of an internal combustion engine, said computer program including:

code for determining a mass flow rate for charged air inducted into said cylinder;

code for determining a mass flow rate for recirculated exhaust gas inducted into said cylinder;

code for determining a temperature of said charged air;

code for determining a temperature of said recirculated exhaust gas; and, code for calculating said temperature in said cylinder responsive to said mass flow rates of said charged air and said recirculated exhaust gas and said temperatures of said charged air and said recirculated exhaust gas.

* * * * *